US005867085A

United States Patent [19]

Kruck et al.

[11] Patent Number: 5,867,085

[45] Date of Patent: Feb. 2, 1999

[54] TEMPERATURE-DEPENDENT SWITCH WITH FIRST AND SECOND ELECTRODES ARRANGED ON A HOUSING COVER

[75] Inventors: Günter Kruck; Marcel Hofsäss, both of Pforzheim, Germany

[73] Assignee: Thermik Gerätebau GmbH, Pforzheim, Germany

[21] Appl. No.: 808,488

[22] Filed: Mar. 3, 1997

[30] Foreign Application Priority Data

Mar. 12, 1996 [DE] Germany ..... 196 09 577.8

[51] Int. Cl.[6] ..... H01H 37/04; H01H 37/74

[52] U.S. Cl. ..... 337/380; 337/343; 337/333

[58] Field of Search ..... 337/333, 334, 337/335, 343, 348, 365, 370, 380

[56] References Cited

U.S. PATENT DOCUMENTS 4,470,033 9/1984 Hofsass ..... 337/343
4,849,729 7/1989 Hofsäss .
5,046,156 9/1991 Hofsäss .

FOREIGN PATENT DOCUMENTS 2121802 1/1973 Germany .
3122899 12/1982 Germany .
3710672 10/1988 Germany .
8908999 10/1990 Germany .

*Primary Examiner*—Leo P. Picard
*Assistant Examiner*—Jayprakash N. Gandhi
*Attorney, Agent, or Firm*—Harness, Dickey & Pierce, P.L.C.

[57] ABSTRACT

A switch having a housing which receives a temperature-dependent switching mechanism is described, the housing having an electrically conductive lower part as well as an electrically insulating cover part, closing off the lower part and attached thereto, on whose inner side a first countercontact, to which through contact is made externally, is provided for the switching mechanism. The lower part serves as the second countercontact of the switching mechanism and creates, as a function of its temperature, an electrically conductive connection between the two countercontacts. Arranged on the cover part in lossproof fashion are a first connection electrode that is connected electrically to the first countercontact, as well as a second connection electrode that is electrically connected to the lower part as a consequence of the attachment of the cover part to the lower part.

24 Claims, 4 Drawing Sheets

TEMPERATURE-DEPENDENT SWITCH WITH FIRST AND SECOND ELECTRODES ARRANGED ON A HOUSING COVER

BACKGROUND OF THE INVENTION

1. Field of the Invention

The present invention relates to a switch having a housing which receives a temperature-dependent switching mechanism and comprises an electrically conductive lower part as well as an electrically insulating cover part, closing off the lower part and attached thereto, on whose inner side a first countercontact, to which through contact is made externally, is provided for the switching mechanism, the lower part serving as the second countercontact of the switching mechanism which creates, as a function of its temperature, an electrically conductive connection between the two countercontacts.

2. Related Prior Art

A switch of this kind is known from DE 37 10 672 A1.

In the known switch, the housing has a lower part made of metal and a cover part, closing off the lower part, that is made of insulating material. The switching mechanism, which comprises a spring disk that carries a movable contact element, is arranged in this housing. The spring disk operates against a bimetallic disk that is slipped over a movable contact element. Below the switching temperature the spring disk, which is braced against the base of the lower part, presses the movable contact element against a countercontact that is provided on the inner side of the cover part and extends outward, in the manner of a rivet, through the wall of the cover. The base of the lower part serves as a further countercontact for the switching mechanism.

The cover part is held in lossproof fashion on the lower part by means of a crimped rim thereof. Electrical connection is accomplished on the one hand via the outside of the lower part, and on the other hand via the external head of the rivet which passes through the cover.

Since the spring disk itself is made of electrically conductive material, below the response temperature of the switching mechanism it ensures a low-resistance electrically conductive connection between the countercontact on the cover part and the countercontact on the lower part. If the temperature of the switching mechanism is then increased, the bimetallic disk suddenly snaps over and pushes the movable contact element away from the countercontact on the cover part against the force of the spring disk, so that the electrical connection is broken.

Switches of this kind are commonly used for temperature monitoring of electrical devices, and are also called thermal switches. As long as the temperature of the electrical device does not exceed a predetermined response temperature, the switch, which for this purpose is connected in series with the load being protected, remains closed. If the temperature of the load then increases above the response temperature, the bimetallic disk snaps over and thus interrupts the flow of current to the load.

It is a disadvantage of the known switch that it is relatively complex to produce. This is due principally to the fact that after production of the cover part, the countercontact must then be fastened onto the cover part; at the same time, an electrically conductive connection out through the wall of the cover part must be provided. This is done in the manner of a rivet that transitions, outside the cover, into a head to which conductors, crimp terminals, etc. can be soldered. This assembly of the countercontact to the cover part can only be performed manually, and is thus very cost-intensive.

A conductor can now be soldered onto the crimped rim of the lower part as a second connector; it is also possible to weld a crimp terminal onto the outer base of the lower part. These measures can also, as a rule, only be performed manually, so that they also are very cost-intensive.

A further disadvantage of the known switch is the fact that because of the cover part produced from insulating material it is not very pressure-stable, so that it is not suitable for applications where it must withstand high pressures. This is the case, for example, when the switch is arranged in motor windings.

A pressure-stable switch is known from DE 21 21 802 A1. This switch also contains in its housing a temperature-dependent switching mechanism as described above. The housing of this switch comprises a cover part as well as a lower part, both of which are cup-shaped and made of electrically conductive material. Crimp terminals are shaped integrally onto both the upper part and the lower part, the crimp terminal of the lower part extending outward through a corresponding cutout in the wall of the upper part. An insulating film is arranged between the upper part and lower part in order to insulate the two housing parts electrically from one another.

The temperature-dependent switching mechanism thus makes contact on the one hand with the lower part via the spring disk, and on the other hand with the cover part via the movable contact element, so that an electrically conductive connection exists between the two crimp terminals as long as the temperature of the switching mechanism is below the response temperature. If the temperature of the switching mechanism increases, this electrical connection is broken in the manner described above.

With this switch as well, the need to introduce the insulating film makes final assembly very complex and therefore achievable only manually. This manual final assembly is not only cost-intensive, but also leads to assembly errors and therefore to a high reject rate.

In the case of the switch known from DE 37 10 672 A1, the principal disadvantage is therefore that it is not pressure-resistant, cannot be produced automatically, and moreover is not reliably sealed against dust because of the crimped rim. The switch known from DE 21 21 802 A1 is more pressure-resistant and also better sealed because it is made entirely of metal, but because of the insulation film that is additionally necessary it is even less suited for automatic production.

SUMMARY OF THE INVENTION

In view of the above, it is an object of the present invention to create a ready-to-connect switch that can be produced automatically, is of simple construction, and can easily be installed on a device being protected. In addition, the new switch should be sealed against dust.

According to the invention this object is achieved, in the case of the switch mentioned at the outset, by the fact that arranged on the cover part in lossproof fashion are a first connection electrode that is connected electrically to the first countercontact, as well as a second connection electrode that is electrically connected to the lower part as a consequence of the attachment of the cover part to the lower part.

The object underlying the invention is completely achieved in this manner.

Specifically, final assembly of the new switch can now be completely automated, since the cover part with the two connection electrodes can be prefabricated. The switching mechanism then simply needs to be introduced into the lower part, and the cover part placed on it, before the lower part and cover part are then attached to one another, which simultaneously creates the connection between the lower part and the second connection electrode. The latter can be configured as, for example, a ring, and can be arranged on the underside of the cover part and have a welding lug pointing outward. After the cover is set onto a rim or a shoulder of the lower part, the second connection electrode thus rests on this rim or shoulder, so that when the cover part is attached to the lower part, the electrical connection between the second connection electrode and the lower part is automatically created.

Since both connection electrodes are now mechanically arranged on the cover part, installation of the switch on a device being protected is considerably simplified, since the external connections of the connection electrodes can now lie in one plane, but at least are located at the same height, when the switch leaves the automatic production machine. In other words, once completely assembled the switch is already ready to connect: no further connection actions are required before the switch can be connected to the device being protected.

A method according to the invention for producing a switch with a housing receiving a temperature-dependent switching mechanism consequently comprises the following steps:

a) Providing for an electrically insulating cover part on which two connection electrodes are arranged in lossproof fashion, the first connection electrode having through contact made to it from outside and being electrically connected to a first countercontact for the switching mechanism provided on the cover part on its inner side;

b) providing for a lower housing part made of electrically conductive material;

c) introducing the switching mechanism into the lower housing part;

d) closing off the lower housing part with the cover part; and e) attaching the cover part to the lower housing part, thereby simultaneously creating an electrical connection between the second connection electrode and the lower housing part, which serves as the second countercontact for the switching mechanism.

With this production method that can be performed entirely automatically, the new switch can be produced on an automatic machine so that manufacturing costs are very low. Because of the high reproducibility of automatic production machines, the reject rate for switches produced in this manner also decreases considerably as compared with manual final assembly, thus also considerably reducing costs for the new switch.

It is preferred in this context, in the case of the new switch, if the first connection electrode is injection-embedded or encapsulated into the cover part in such a way that it is an integral component of the cover part and projects out of the cover part with a connector element.

It is further preferred if the second connection electrode is injection-embedded or encapsulated into the cover part in such a way that it is an integral component of the cover part and projects out of the cover part with a connector element.

This feature is advantageous in terms of production engineering because injection-embedding or encapsulation allows very simple attachment of the connection electrodes to the cover part. The connection electrodes can, for example, be injection-embedded into the cover part successively or simultaneously, which can also be done automatically.

In an embodiment, it is preferred if the first connection electrode extends in the cover part as a tab, from its connector element to the first countercontact arranged approximately centeredly; it is further preferred if the second connection electrode is configured in the cover part as an annular segment into which the first connection electrode extends.

This feature imparts great stability to the cover part, especially since the two connection electrodes can now lie in one plane. In addition to the great mechanical stability of the cover part, these features have the additional advantage that the two connection electrodes can be injection-molded into the cover part in a single operation, so that production is once again simplified.

It is preferred in this context if the first and the second connection electrodes are punched out of a common sheet-metal part.

The advantage here is that production of the two connection electrodes can also be automated. The two connection electrodes can be delivered, for example, in ribbon form on a strip, so that thereafter they simply need to be automatically injection-embedded.

In an embodiment of the method according to the invention, it is preferred in this context if step a) has the following substeps:

Punching out the two connection electrodes from a common piece of sheet metal; and injection-embedding the connection electrodes into the cover part.

The advantage with these features is that both punching out and injection-embedding of the connection electrodes require only a very few process steps, which moreover can be completely automated.

It is preferred in general in the case of the new switch if angled, upward-facing clips, which hold the cover part and make contact with the second connection electrode, are provided on the lower part, the lower part preferably being a deep-drawn part with a circumferential rim that engages into an annular groove in the cover part. It is further preferred here if the cover part and optionally the second connection electrode have slots for the clips of the lower part.

The advantage with these features is that the new switch is sealed against dust due to the coaction between the circumferential rim and annular groove. Assembly is also simplified because of the slots coacting with the clips, since the cover part is centered/positioned on the clips by means of the slots, allowing easy automatic production.

It is preferred in this context if the cover part overlaps the lower part and has pockets, open upward and radially outward, into whose bases the slots open and on whose bases the second connection electrode is accessible for the clips.

This feature is advantageous in terms of simple assembly: because the pockets are open upward and radially outward, the vertical clips can now be bent over from the side and from above, thus achieving not only attachment of the cover part to the lower part, but also simultaneously, via the clips, electrical contact between the lower part and the second connection electrode. This feature furthermore has the advantage that only a very few production steps, which moreover can also be automated, are required in order to achieve mechanical attachment of the cover part to the lower part and electrical connection of the second connection electrode to the lower part.

In an embodiment of the new method, it is preferred in this context if step b) has the following sub-step:

Deep-drawing the lower part in such a way that it has clips extending vertically in the direction of the cover part that is to be put in place.

It is preferred in this context if, in step d), the cover part is placed onto the lower part in such a way that clips of the lower part are inserted through slots of the cover part and optionally of the first connection electrode.

In an embodiment, it is preferred if, in step e), the clips are bent over in such a way that they come to rest in pockets of the cover part which are open upward and radially outward, and there make contact with uncovered regions of the second connection electrode and simultaneously attach the cover part to the lower part.

These automatic production features yield advantages in that only a few production steps are needed in order to center the cover part on the lower part and attach it to the latter, and lastly also create the electrical connection between the lower part and the second connection electrode.

In an embodiment of the new switch, it is preferred if walls of the pockets project upward beyond the bent-over clips.

The advantage with this feature is that no electrically conductive parts project upward beyond the new switch, so that it is insulated at the top. Because of the electrically conductive lower part, however, very good thermal contact is possible on the underside of the new switch.

In an embodiment, it is preferred if the first countercontact is configured as a downwardly bent, angled free end of the first connection electrode which is configured as a tab.

The advantage here is that only one part is needed in order to implement both the connection electrode and the countercontact. The first connection electrode is punched and then in this context embossed and/or pressed so that the free end is bent downward. This connection electrode is then appropriately injection-embedded or encapsulated into the cover part, so that only a very few production steps are required in order to produce the first connection electrode and the first countercontact joined thereto, and arrange them in lossproof fashion on the cover part. Because of the simple production steps, this production segment is also particularly easy to automate.

On the other hand, however, it is preferred if the first countercontact has a stud that is inserted from the inner side of the cover part into a centered orifice in the cover part and in the first connector element, and is held on the first connector element by means of an insulation displacement and clamp connection.

The advantage here is that although two parts now need to be used, overall production is very simple, since on the one hand the first connector element does not need to be bent. On the other hand, the countercontact simply needs to be inserted with its stud into the orifice, where it is held by the insulation displacement and clamp connection without further actions. Thus in the case of this embodiment as well, attachment of the first countercontact to the cover part can be effected automatically, only a few production steps being necessary.

It is preferred in this context, in the case of the new method, if step a) has the further sub-step:

Inserting the first countercontact with its stud, from the inner side of the cover part, into an orifice passing through the cover part and the first connection electrode, the stud being attached to the first connection electrode by means of an insulation displacement and clamp connection.

The advantage of this feature is that by means of a simple insertion motion, the countercontact is attached to the cover part and simultaneously connected to the first connection electrode, so that the new production method as a whole involves very few steps.

It is preferred in general, in the case of the new switch, if the switching mechanism comprises a spring disk, operating against a bimetallic snap disk, that is braced at its rim against the lower part and carries a movable contact element that it presses, below a switching temperature of the switching mechanism, against the first countercontact, the movable contact element preferably being held in lossproof fashion on the spring disk by either being welded onto the latter or being configured integrally with the spring disk.

The advantage with these features that can be alternatively provided is that introduction of the switching mechanism into the lower part can very easily be performed automatically, since the movable contact element cannot get lost or become jammed. In the case of the two switches mentioned at the outset, this contact element is simply introduced loose into the spring disk, so that in these cases, in which assembly can only be performed manually, jamming of an incorrectly introduced contact element, and therefore a reject part, can occur. When the contact element is arranged in lossproof fashion on the spring disk, however, it cannot either get lost or become jammed, so that this assembly step can also easily be automated.

It is further preferred if the lower part has buttons, located radially and externally and arranged in circumferentially distributed fashion on its base, as support for the rim of the spring disk, three buttons preferably being provided, arranged at approximately equal circumferential distribution.

The advantage with this feature is that the spring disk sits evenly even if its rim is slightly uneven because it was produced by punching. The spring disk thus cannot tilt or wobble in the lower part, so that once the spring disk is introduced the position of the movable contact is defined and the bimetallic snap disk can be automatically slipped over the said contact. These features thus once again make possible very easy automatic production.

Moreover, however, it is also advantageous in the case of ordinary switches, which have a housing with a temperature-dependent switching mechanism consisting of spring disk, movable contact element, and bimetallic snap disk, if the spring disk rests with its rim on buttons located radially and externally and arranged in circumferentially distributed fashion on the base of the lower part. These buttons then serve as a second countercontact for the switching mechanism; they can either be part of the electrically conductive lower part, or part of a second connection electrode that is arranged in the lower part.

A switch of this kind is also inventive per se, since it solves the problem of a spring disk that does not sit evenly. The reason is that turned or punched chamfered parts are often used as the contact surface for the spring disk, but because they are produced by punching their rim does not necessarily lie in one plane. The result of this is then that the disk does not sit evenly, so that in some cases the current flows into the lower part of the switch through only a very small contact region of the spring disk. If the buttons according to the invention are used, however, the spring disk rests (especially when three buttons are used) securely and firmly on these three support points, so that in addition to the capability of automated production whose advantages have already been described above, a further advantage consists in the fact that current transfer from the spring disk into the lower part always occurs at the three buttons.

In this connection, it is advantageous in the case of the new method if step b) has the further sub-step:

Equipping the lower part on its base with buttons, located radially and externally and arranged in circumferentially distributed fashion, as support for the switching mechanism.

The advantages of this feature have already been discussed in detail above.

Further advantages are evident from the description and the attached drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

Embodiments of the invention are depicted in the drawings and will be explained in more detail in the description below. In the drawings.

DETAILED DESCRIPTION OF THE PREFERRED EMBODIMENTS

Figure 1:
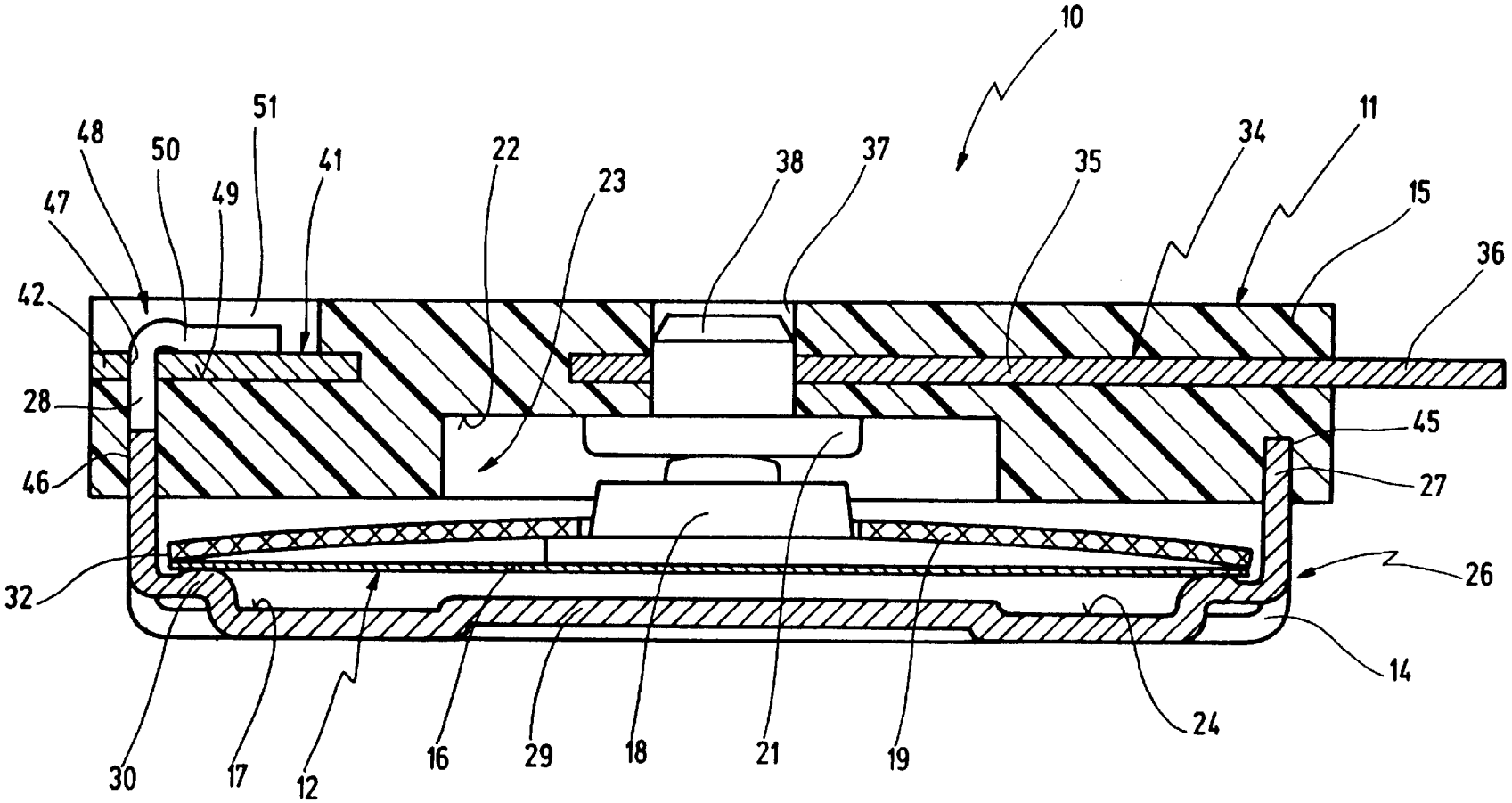
FIG. 1 shows a longitudinal section through the new switch.

In FIG. 1, 10 designates the new switch which has a housing 11 in which a temperature-dependent switching mechanism 12 is arranged.

Housing 11 comprises a lower part 14 made of conductive material, preferably metal, as well as a cover part 15, made of insulating material, which closes off lower part 14.

The temperature-dependent switching mechanism 12 has, in known fashion, a spring disk 16 that is braced in lower part 14 against its base 17. Spring disk 16 carries a movable contact element 18 that, in the embodiment shown, is welded onto spring disk 16. A bimetallic snap disk 19 is slipped, in known fashion, over contact element 18.

In the low-temperature position shown in FIG. 1, i.e. below the response temperature of switching mechanism 12, spring disk 16 presses movable contact element 18 against a first countercontact 21 that is arranged on cover part 15 on its inner side 22 in a circular depression 23. Conductive lower part 14 itself acts as the second countercontact 24 for switching mechanism 12.

Figure 2:
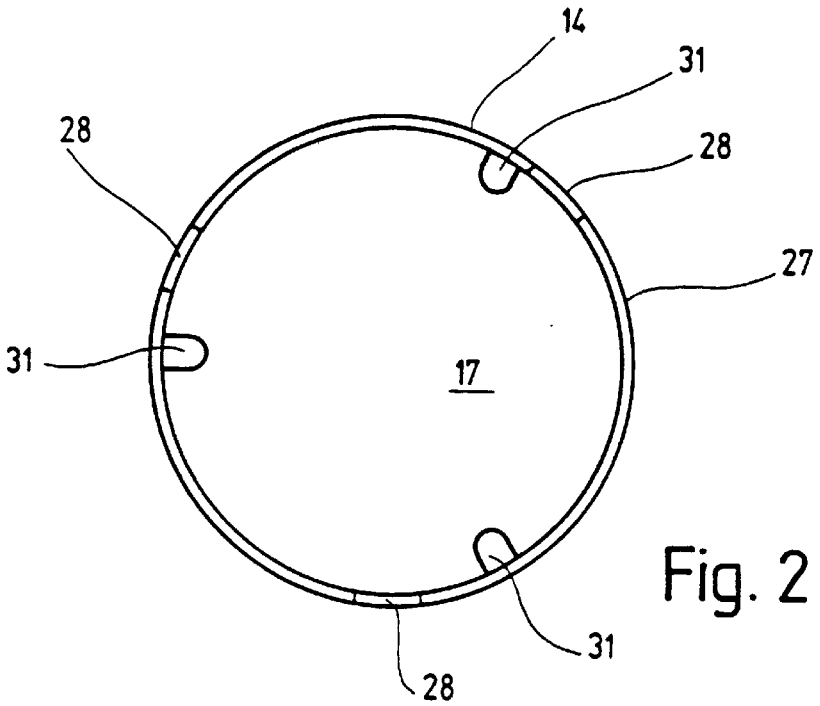
FIG. 2 shows a plan view of a further embodiment of the lower part of the switch of FIG. 1.

Lower part 14 is a deep-drawn part 26 with a circumferential elevated rim 27 from which three clips 28 extend upward, as is also evident from the plan view of lower part 14 in FIG. 2. A reinforcing bead 29 which imparts mechanical stability to lower part 14 is also provided on base 17 of lower part 14.

A support ridge 30, on which spring disk 16 rests, extends radially and externally around base 17.

In the alternative embodiment of FIG. 2, instead of support ridge 30 three buttons 31, located radially and externally and arranged in circumferentially distributed fashion, are provided, on which spring disk 16 rests at its rim 32. Because of this three-point support of spring disk 16, it is always in contact with all three buttons 31 via its rim 32.

In order to provide external contact for the new switch 10, cover part 15 is configured integrally with a first connection electrode 34 which comprises an angled tab 35 that extends from its externally located connector element 36 to the region of an orifice 37 where first countercontact 21 is arranged. This first countercontact 21 sits with its stud 38 in orifice 37, which extends through cover part 15 and through tab 35 of first connection electrode 34. An insulation displacement and clamp connection exists between stud 38 and orifice 37, so that stud 38 is securely held in orifice 37 by simple insertion.

Figure 3:
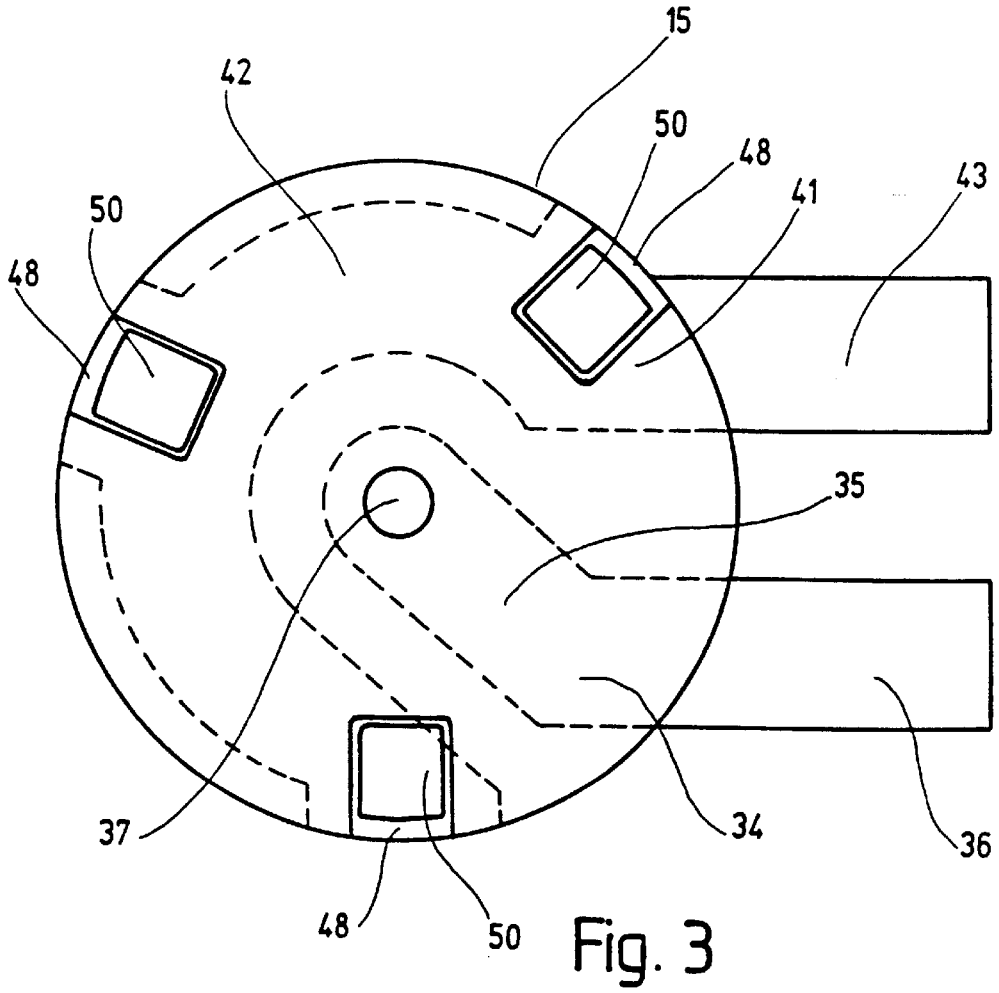
FIG. 3 shows a plan view of the cover part in the case of the switch of FIG. 1.

The insulating cover part 15 has, as a further integral component, a second connection electrode 41 that, in accordance with FIG. 3, comprises an annular segment 42 to which externally located connector element 43 is adjacent.

The two connection electrodes 34 and 41 were injection-embedded into cover part 15 during production, so that they are an integral component of cover part 15.

As is evident in particular from the sectioned representation of FIG. 1, the two connection electrodes 34 and 41 lie in one plane, which is made possible by the fact that the angled tab 35 can extend into the open region of annular segment 42.

It is also evident from FIG. 1 that cover part 15 has a circumferential annular groove 45 in which circumferential rim 27 of lower part 14 lies so that the interior of switch 10 is sealed against dust.

Also provided in cover part 15, three times, is a slot 46 adjoining which is a further slot 47 that is provided in annular segment 42. These two slots 46, 47 open into a pocket 48, open radially outward and upward, into which clip 28 projects from below. Provided in pocket 48 on its base 49 is an exposed region of second connection electrode 41, so that the bent-over upper end 50 of clip 28 is in contact with second connection electrode 41 and thereby not only creates an electrical connection to lower part 14 but at the same time also attaches cover part 15 to lower part 14.

Also evident in FIG. 1 is that pocket 48 has a wall 51 which projects upward beyond the bent-over upper end 50 of clip 28, so that no electrically conductive parts protrude upward above the new switch 10, which is thus protected at the top from undesirable electrical contact.

The new switch 10 can, however, be brought into good thermal contact via its electrically conductive lower part 14 with a component being protected.

Switch 10 as described so far operates as follows: At the low temperature shown in FIG. 1, an electrically conductive connection exists from connector element 36 of first connection electrode 34, via first countercontact 21, movable contact element 18, spring disk 16 made of electrically conductive material, buttons 31 or support ridge 30, conductive lower part 14, vertical clips 28, and annular segment 42, to connector element 43 of second connection electrode 41. When the temperature increases, bimetallic snap disk 19 snaps over from the convex position shown into a concave position, and then thereby presses movable contact element 18, against the force of spring disk 16, away from first countercontact 21. Bimetallic snap disk 19 and spring disk 16, which ultimately also snaps over at some point in time, are then braced against the insulating cover part 15, so that although the central region of spring disk 16 is in contact with reinforcing bead 29, an electrical connection now no longer exists between the two connector elements 36, 43.

Figure 4:
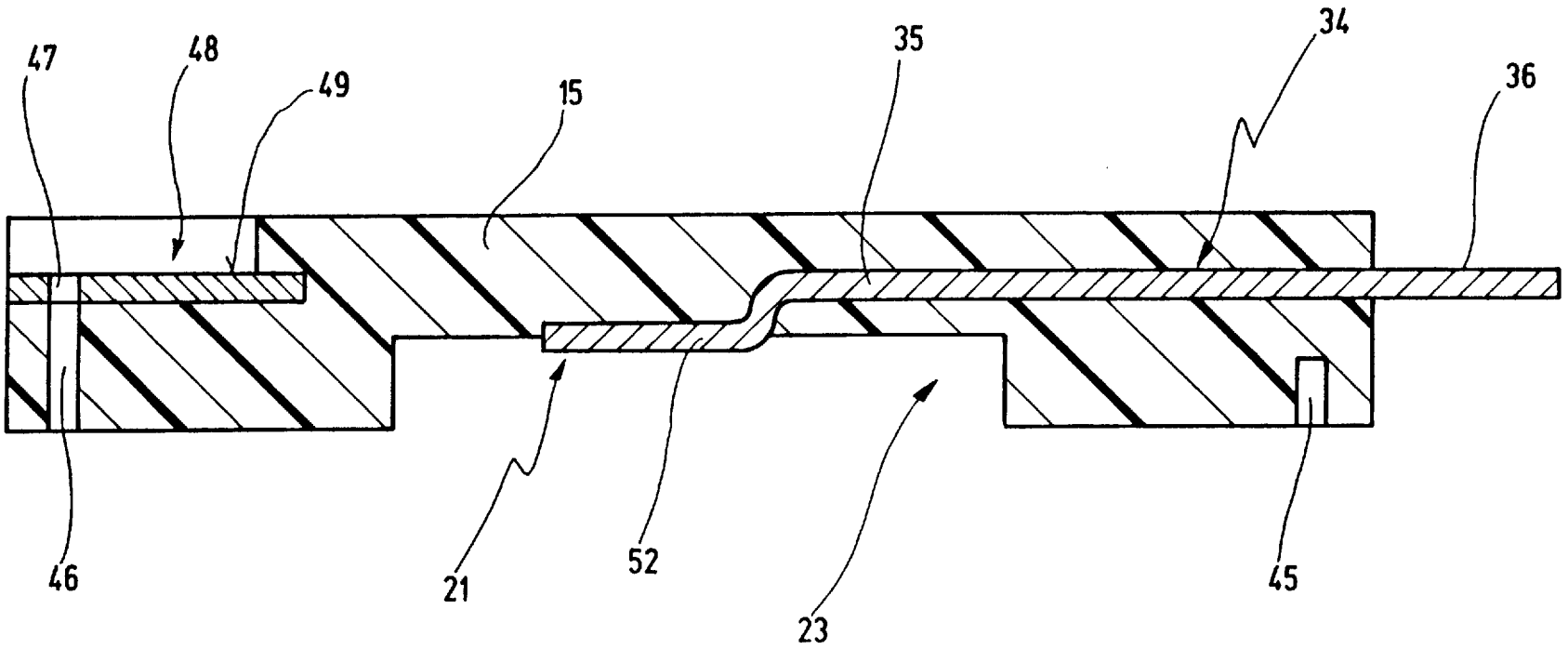
FIG. 4 shows a longitudinal section through a further embodiment of the cover part of the switch of FIG. 1.

FIG. 4 shows an alternative embodiment of cover part 15, in which instead of an insulated first countercontact 21, angled tab 35 is extended and bent downward at its free end 52 in such a way that first countercontact 21 is configured, so to speak, integrally with first connection electrode 34. The other features of cover part 15 of FIG. 4 correspond to those of cover part 15 of FIG. 1, and are accordingly given the same reference symbols.

Figure 5:
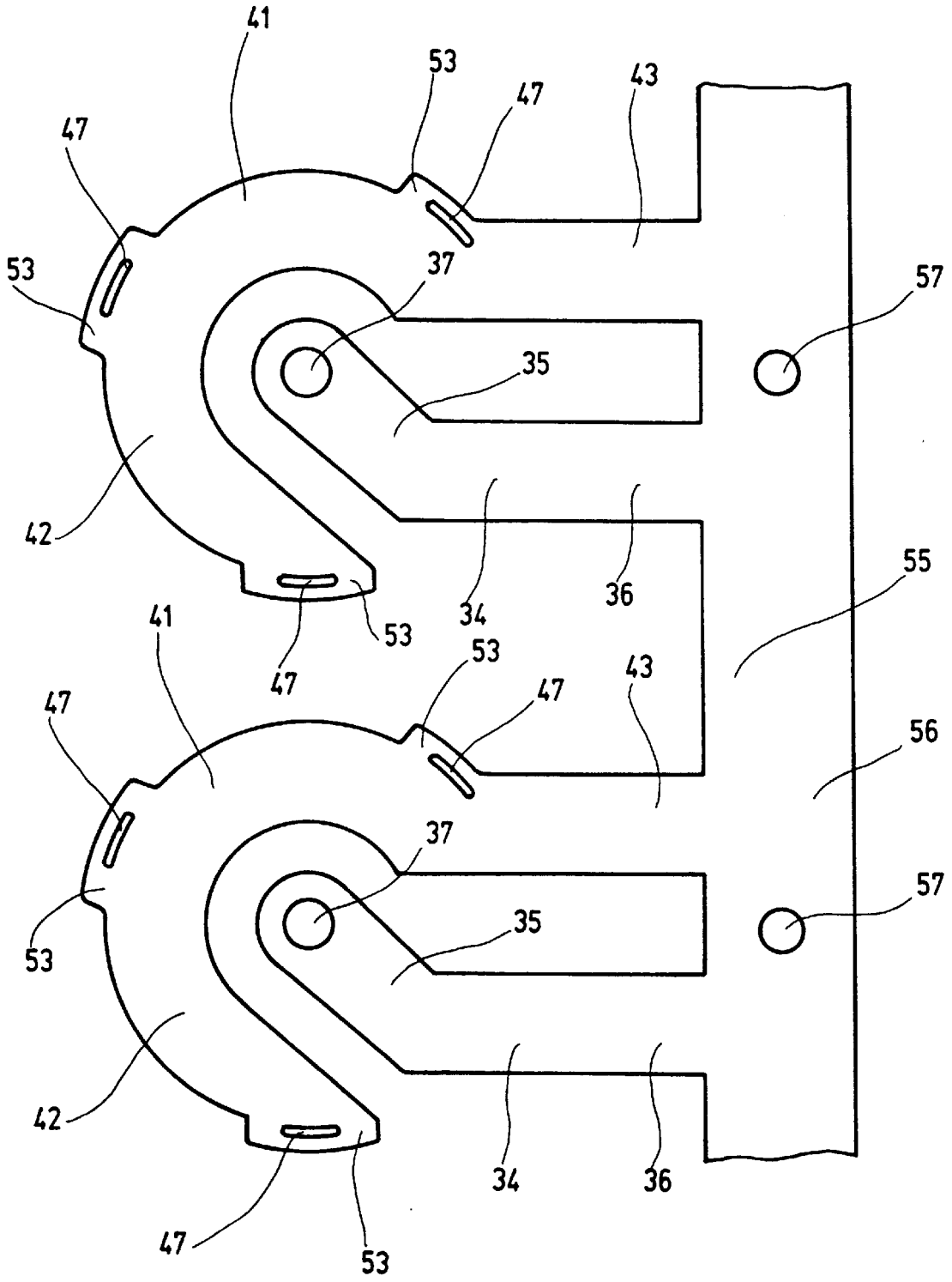
FIG. 5 shows the connection electrode used in the new switch of FIG. 1, as delivered on the strip prior to injection-embedding into the cover part.

FIG. 5, lastly, shows the two connection electrodes 34, 41 before being injection-embedded into cover part 15. It is evident that slots 47 are arranged in protrusions 53 so that the reinforcing material there ensures appropriate retention of clips 28.

The two connection electrodes 34, 41 are guided with their connector elements 36, 43 integrally on a sheet-metal strip 55 that has been punched out, together with connection electrodes 34, 41, from a common sheet-metal piece 56. Also evident are transport holes 57 by means of which strip 55 is moved in the context of an automatic production process.

Production of switch 10 as described so far is accomplished as follows:

Firstly, connection electrodes 34, 41 as shown in FIG. 5 are punched out of common sheet-metal piece 56 and thereupon injection-embedded into cover part 15 so that they become an integral component of the cover part, as shown in FIGS. 1 and 4.

Lower part 14 is then produced as a deep-drawn part; in addition to vertical circumferential rim 27, clips 28 and either buttons 31 or support ridge 30 are also configured during deep-drawing and prior punching. This lower part 14 is conveyed in bulk to an automatic production machine, where it is positioned and introduced into pallets. Clips 28 which may have become bent during transport are then re-straightened.

Concurrently therewith, the spring disk is punched out of strip material, bent, heat-treated, and equipped with a contact element 18 that is either welded on or embossed out.

The bimetallic snap disk is also delivered in bulk to the automatic production machine.

Next, spring disk 16 with contact element 18 held thereon in lossproof fashion is introduced into lower part 14. In particular if the three buttons 31 are provided, spring disk 16 rests securely on base 17 of lower part 14.

The automatic production machine then slips bimetallic snap disk 19 over contact element 18, the position of which is precisely known and securely established because of buttons 31.

Cover part 15, prefabricated as described above, is then placed onto lower part 14 in such a way that the three clips 28 engage upward through slots 46, 47 into pockets 48. Clips 28 result in a kind of positioning/centering of cover part 15 on lower part 14.

After cover part 15 has been put in place, bending tools then engage laterally and from above into the three pockets 48 and bend upper ends 50 of clips 28 over as shown in FIG. 1, so that they come to rest on the freely accessible regions of second connection electrode 41.

All the steps described to this point can be performed completely automatically.

Therefore, what we claim, is:

1. A switch, comprising a temperature-dependent switching mechanism, a housing containing said temperature-dependent switching mechanism, said housing including a lower part made of electrically conductive material and an electrically insulating cover part closing off said lower part, and attached thereto, said cover part having an inner surface and a first countercontact for the temperature-dependent switching mechanism, said first countercontact being arranged at said inner surface, a first connection electrode being captively arranged on the cover part, said first connection electrode connected electrically to the first countercontact, a second connection electrode being captively arranged on the cover part, said second connection electrode electrically connected to the lower part as a consequence of the attachment of the cover part to the lower part, said lower part serving as a second countercontact for the temperature-dependent switching mechanism and having angled, upward-facing clips, which hold the cover part and make contact with the second connection electrode, said temperature-dependent switching mechanism creating an electrically conductive connection between said first and second countercontacts, whereby external contact is made to the first and second connection electrodes.

2. The switch of claim 1, wherein the first connection electrode is injection-embedded or encapsulated into the cover part in such a way that it is an integral component of the cover part and projects out of the cover part with a connector element.

3. The switch of claim 2, wherein the second connection electrode is injection-embedded or encapsulated into the cover part in such a way that it is an integral component of the cover part and projects out of the cover part with a connector element.

4. The switch of claim 3, wherein the first connection electrode extends in the cover part as a tab, from its connector element to the first countercontact that is arranged approximately centeredly.

5. The switch of claim 3, wherein the first and the second connection electrodes are punched out of a common sheet-metal part.

6. The switch of claim 4, wherein the second connection electrode is configured in the cover part as an annular segment into which the first connection electrode extends.

7. The switch of claim 4, wherein the first countercontact is configured as a downwardly bent, angled free end of the first connection electrode which is configured as a tab.

8. The switch of claim 4, wherein the first countercontact has a stud that is inserted from the inner side into centered orifices provided in the cover part and in the first connector element, and is held on the first connector element by means of an insulation displacement and clamp connection.

9. The switch of claim 1, wherein the lower part is a deep-drawn part with a circumferential rim that engages into an annular groove in the cover part.

10. The switch of claim 1, wherein the cover part and optionally the second connection electrode have slots for the clips.

11. The switch of claim 10, wherein the cover part overlaps the lower part and has pockets, open upward and radially outward, into whose bases the slots open and on whose bases the second connection electrode is accessible for the clips.

12. The switch of claim 11, wherein walls of the pockets project upward beyond the bent-over clips.

13. The switch of claim 1, wherein the switching mechanism comprises a spring disk, operating against a bimetallic snap disk, that is braced at its rim against the lower part and carries a movable contact element that it presses, below a switching temperature of the switching mechanism, against the first countercontact.

14. The switch of claim 13, wherein the movable contact element is held in lossproof fashion on the spring disk.

15. The switch of claim 14, wherein the movable contact element is welded onto the spring disk.

16. The switch of claim 14, wherein the movable contact element is configured integrally with the spring disk.

17. The switch of claim 13, wherein the lower part has buttons, located radially and externally and arranged in circumferentially distributed fashion on its base, as support for the rim of the spring disk.

18. The switch of claim 17, wherein three buttons are provided, in approximately equally circumferentially distributed fashion.

19. A switch, comprising a temperature-dependent switching mechanism, a housing containing said temperature-dependent switching mechanism, said housing including a lower part made of electrically conductive material and an electrically insulating cover part closing off said lower part, and attached thereto, said lower part comprising a deep-drawn part with a circumferential rim that engages into an annular groove in the cover part, said cover part having an inner surface and a first countercontact for the temperature-dependent switching mechanism, said first countercontact being arranged at said inner surface, a first connection electrode being captively arranged on the cover part, said first connection electrode connected electrically to the first countercontact, a second connection electrode being captively arranged on the cover part, said second connection electrode electrically connected to the lower part as a consequence of the attachment of the cover part to the lower part, said lower part serving as a second countercontact for the temperature-dependent switching mechanism, said temperature-dependent switching mechanism creating an electrically conductive connection between said first and second countercontacts, whereby external contact is made to the first and second connection electrodes.

20. A switch, comprising a temperature-dependent switching mechanism, a housing containing said temperature-dependent switching mechanism, said housing including a lower part made of electrically conductive material and an electrically insulating cover part closing off said lower part, and attached thereto, said cover part having an inner surface and a first countercontact for the temperature-dependent switching mechanism, said first countercontact being arranged at said inner surface, a first connection electrode being captively arranged on the cover part, said first connection electrode connected electrically to the first countercontact and extending in the cover part as a tab, from its connector element to the first countercontact that is arranged approximately centeredly and configured as a downwardly bent, angled free end of the first connection electrode, a second connection electrode being captively arranged on the cover part, said second connection electrode electrically connected to the lower part as a consequence of the attachment of the cover part to the lower part, said lower part serving as a second countercontact for the temperature-dependent switching mechanism, said temperature-dependent switching mechanism creating an electrically conductive connection between said first and second countercontacts, whereby external contact is made to the first and second connection electrodes.

21. A switch, comprising a temperature-dependent switching mechanism, a housing containing said temperature-dependent switching mechanism, said housing including a lower part made of electrically conductive material and an electrically insulating cover part closing off said lower part, and attached thereto, said cover part having an inner surface and a first countercontact for the temperature-dependent switching mechanism, said first countercontact being arranged at said inner surface, a first connection electrode being captively arranged on the cover part, said first connection electrode connected electrically to the first countercontact and extending in the cover part as a tab, from its connector element to the first countercontact that is arranged approximately centeredly, the first countercontact having a stud that is inserted from the inner side into centered orifices provided in the cover part and in the first connector element, and is held on the first connector element by means of an insulation displacement and clamp connection, a second connection electrode being captively arranged on the cover part, said second connection electrode electrically connected to the lower part as a consequence of the attachment of the cover part to the lower part, said lower part serving as a second countercontact for the temperature-dependent switching mechanism, said temperature-dependent switching mechanism creating an electrically conductive connection between said first and second countercontacts, whereby external contact is made to the first and second connection electrodes.

22. A switch, comprising a temperature-dependent switching mechanism, a housing containing said temperature-dependent switching mechanism, said housing including a lower part made of electrically conductive material and an electrically insulating cover part closing off said lower part, and attached thereto, said cover part having an inner surface and a first countercontact for the temperature-dependent switching mechanism, said first countercontact being arranged at said inner surface, a first connection electrode being captively arranged on the cover part, said first connection electrode connected electrically to the first countercontact, a second connection electrode being captively arranged on the cover part, said second connection electrode electrically connected to the lower part as a consequence of the attachment of the cover part to the lower part, said lower part serving as a second countercontact for the temperature-dependent switching mechanism, said temperature-dependent switching mechanism creating an electrically conductive connection between said first and second countercontacts, whereby external contact is made to the first and second connection electrodes, wherein the switching mechanism comprises a spring disk, operating against a bimetallic snap disk, that is braced at its rim against the lower part and carries a movable contact element that it presses, below a switching temperature of the switching mechanism, against the first countercontact, and further wherein the lower part has buttons, located radially and externally and arranged in circumferentially distributed fashion on its base, as support for the rim of the spring disk.

23. The switch of claim 22, wherein three buttons are provided, in approximately equally circumferentially distributed fashion.

24. A switch, comprising a temperature-dependent switching mechanism, a housing containing said temperature-dependent switching mechanism, said housing including a lower part made of electrically conductive material and an electrically insulating cover part closing off said lower part, and attached thereto, said cover part having an inner surface and a first countercontact for the temperature-dependent switching mechanism, said first countercontact being arranged at said inner surface, a first connection electrode being captively arranged on the cover part, said first connection electrode connected electrically to the first countercontact and extending in the cover part as a tab, from its connector element to the first countercontact that is arranged approximately centeredly, a second connection electrode being captively arranged on the cover part and configured as an annular segment into which the first connection electrode extends, said second connection electrode electrically connected to the lower part as a consequence of the attachment of the cover part to the lower part, said lower part serving as a second countercontact for the temperature-dependent switching mechanism, said temperature-dependent switching mechanism creating an electrically conductive connection between said first and second countercontacts, whereby external contact is made to the first and second connection electrodes.

* * * * *